US010857803B2

(12) United States Patent
Hiramoto

(10) Patent No.: US 10,857,803 B2
(45) Date of Patent: Dec. 8, 2020

(54) PRINTING APPARATUS AND PRINTING METHOD

(71) Applicant: SEIKO EPSON CORPORATION, Tokyo (JP)

(72) Inventor: Goki Hiramoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 63 days.

(21) Appl. No.: 16/313,822

(22) PCT Filed: Jun. 15, 2017

(86) PCT No.: PCT/JP2017/022170
§ 371 (c)(1),
(2) Date: May 16, 2019

(87) PCT Pub. No.: WO2018/003524
PCT Pub. Date: Jan. 4, 2018

(65) Prior Publication Data

US 2019/0263134 A1 Aug. 29, 2019

(30) Foreign Application Priority Data

Jul. 1, 2016 (JP) ..... 2016-131768

(51) Int. Cl.
*B41J 2/175* (2006.01)
*B41J 29/38* (2006.01)
*B41J 2/19* (2006.01)

(52) U.S. Cl.
CPC ..... *B41J 2/17563* (2013.01); *B41J 2/175* (2013.01); *B41J 2/19* (2013.01); *B41J 29/38* (2013.01)

(58) Field of Classification Search
CPC ..... B41J 2/175; B41J 2/17563; B41J 29/38
(Continued)

(56) References Cited

U.S. PATENT DOCUMENTS 7,537,328 B2 * 5/2009 Okubo ..... B41J 2/17509 347/93
8,080,093 B2 * 12/2011 Ito ..... B41J 2/17509 210/640

(Continued)

FOREIGN PATENT DOCUMENTS

JP S5586755 6/1980
JP 06-340084 A 12/1994

(Continued)

OTHER PUBLICATIONS

International Search Report dated Aug. 8, 2017 for PCT/JP2017/022170.

(Continued)

*Primary Examiner* — An H Do
(74) *Attorney, Agent, or Firm* — Workman Nydegger

(57) ABSTRACT

A printing apparatus includes a storage unit configured to store ink; a discharge unit configured to discharge the ink for printing; and an ink flow path configured to couple the storage unit to the discharge unit and allow the ink to flow down from the storage unit to the discharge unit, wherein the ink flow path includes a first flow path, a first filter provided in the first flow path and configured to collect a foreign material in the ink passing through the first flow path, a second flow path independent of the first flow path, and a second filter configured to collect a foreign material in the ink passing through the second flow path, wherein the printing apparatus is configured to switch the flow path of the ink between the first flow path and the second flow path based on a predetermined condition.

13 Claims, 9 Drawing Sheets

(58) Field of Classification Search
USPC ..... 347/84, 85, 93
See application file for complete search history.

(56) References Cited

U.S. PATENT DOCUMENTS

| | | | | |
|---|---|---|---|---|
| 8,596,775 | B2 * | 12/2013 | Koike | B41J 2/17563 347/92 |
| 2006/0176346 | A1 | 8/2006 | Momose | |
| 2007/0252877 | A1 | 11/2007 | Okubo | |
| 2011/0304678 | A1 * | 12/2011 | Yamamoto | B41J 29/38 347/93 |
| 2013/0050362 | A1 | 2/2013 | Koike | |
| 2016/0075145 | A1 | 3/2016 | Ando et al. | |
| 2017/0050444 | A1 | 2/2017 | Urakami et al. | |
| 2019/0061361 | A1 * | 2/2019 | Fukushima | B41J 2/17563 |

FOREIGN PATENT DOCUMENTS

| | | | |
|---|---|---|---|
| JP | 2006-198846 | A | 8/2006 |
| JP | 2007-296660 | A | 11/2007 |
| JP | 2011-031447 | A | 2/2011 |
| JP | 2011-212872 | A | 10/2011 |
| JP | 2012-192328 | A | 10/2012 |
| JP | 2015-058544 | A | 3/2015 |
| JP | 2015-182444 | A | 10/2015 |
| JP | 2015-190201 | A1 | 12/2015 |

OTHER PUBLICATIONS

European Search Report issued in corresponding application No. EP17819884 dated Jan. 10, 2020.

* cited by examiner

PRINTING APPARATUS AND PRINTING METHOD

The entire disclosure of Japanese Patent Application No. 2016-131768, filed Jul. 1, 2016 is expressly incorporated by reference herein.

TECHNICAL FIELD

The invention relates to a printing apparatus and a printing method.

BACKGROUND ART

Printing apparatuses that apply ink on a recording medium for printing have been used (for example, see PTL 1). A printing apparatus described in PTL 1 includes a head main body having a nozzle configured to discharge ink, a storage unit configured to store ink, a supply flow path configured to couple the nozzle to the storage unit, and a filter provided in the supply flow path.

The filter serves to catch and remove ink precipitates, dusts, and other foreign materials present in the ink flowing down the supply flow path. In this manner, such foreign materials are prevented from being discharged from the nozzle.

As the filter collects the foreign materials, the accumulated foreign materials may clog the filter. Thus, the filter needs to be replaced with a new one when foreign materials accumulate in the filter.

However, the printing apparatus described in PTL 1 requires termination of the printing process in order to replace the filter during printing. This leads to a decreased printing efficiency.

CITATION LIST

Patent Literature

[PTL 1] JP-A-2007-296660

SUMMARY OF INVENTION

Technical Problem

An object of the invention is to provide a printing apparatus and a printing method in which lowering of the printing efficiency is prevented.

Solution to Problem

The above-described objective is achieved by the invention below.

A printing apparatus includes a storage unit configured to store ink, a discharge unit to which the ink is supplied from the storage unit, the discharge unit being configured to discharge the ink for printing, and an ink flow path configured to couple the storage unit to the discharge unit and allow the ink to flow down from the storage unit to the discharge unit, wherein the ink flow path includes a first flow path, a first filter provided in the first flow path and configured to collect a foreign material in the ink passing through the first flow path, a second flow path independent of the first flow path, and a second filter configured to collect a foreign material in the ink passing through the second flow path, wherein the printing apparatus is configured to switch the flow path of the ink between the first flow path and the second flow path based on a predetermined condition.

Such an arrangement enables switching of the flow path from the first flow path to the second flow path when the first filter is clogged during use of the first flow path, so that printing does not need to be discontinued. In addition, by switching to the second flow path, the first filter can be replaced even during printing by blocking the ink flow through the first low path.

According to the invention, even when one of the filters is clogged, printing can continue. This prevents decrease in the print efficiency.

In the printing apparatus of the invention, the ink flow path is preferably branched into the first flow path and the second flow path in the ink flow path.

In this manner, the arrangement of the ink flow path can be simplified, as compared to an arrangement in which the first flow path and the second flow path are independent of each other over the entire length of the ink flow path in a longitudinal direction.

In the printing apparatus of the invention, the first flow path and the second flow path in the ink flow path preferably meet downstream of the branch point of the first flow path and the second flow path.

In this manner, the arrangement of the ink flow path can be simplified, as compared to an arrangement in which the first flow path and the second flow path are independent over the entire length of the ink flow path in a longitudinal direction.

In the printing apparatus of the invention, the first filter is preferably removable from the first flow path and the second filter is preferably removable from the second flow path.

This allows each of the first filter and the second filter to be replaced with a new filter.

In the printing apparatus of the invention, the first flow path is preferably removable together with the first filter and the second flow path is preferably removable together with the second filter.

This facilitates replacement of the first filter and the second filter with a new filter.

In the printing apparatus of the invention, it is preferred that the ink flow path includes an upstream pressure detection unit provided upstream of the first filter and the second filter in the ink flow path, and configured to detect pressure in the ink flow path, and a downstream pressure detection unit provided in the ink flow path downstream of the first filter and the second filter, and configured to detect pressure in the ink flow path.

This allows detection of the pressure upstream of the first filter and the second filter as well as the pressure downstream of the first filter and the second filter.

In the printing apparatus of the invention, it is preferred that the first flow path and the second flow path are switched from one to the other based on the pressure detected by the upstream pressure detection unit and the pressure detected by the downstream pressure detection unit.

This makes it possible to know precisely when the first filter and the second filter are to be replaced.

In the printing apparatus according to the invention, it is preferred that the printing apparatus includes a movable unit including the discharge unit, the movable unit being movable in a case that the printing is performed, wherein the first filter and the second filter move along with the movable unit.

In this manner, any foreign material formed in the movable unit can be readily collected by the first filter or the second filter.

In the printing apparatus according to the invention, the replacement operation of the first filter or the second filter is preferably performed while the printing is out of operation.

This facilitates the replacement operation.

In the printing apparatus according to the invention, it is preferred that the printing apparatus includes a movable unit including the discharge unit, the movable unit being movable in a case that the printing is performed, wherein the first filter and the second filter will not move regardless of whether the movable unit is moving.

Accordingly, the replacement operation can be performed whether printing is in operation or out of operation.

In the printing apparatus according to the invention, the replacement operation of the first filter or the second filter is preferably performed while the printing is in operation or out of operation.

This facilitates the replacement operation.

The printing apparatus according to invention preferably includes a waste liquid flow path coupled with each of the first flow path and the second flow path, the waste liquid flow path being configured to discharge the ink in the first flow path and the second flow path.

This allows the replacement operation to be performed while the first flow path or the second flow path is empty.

The printing apparatus according to invention preferably includes a deaerating unit provided in each of the first flow path and the second flow path, the deaerating unit being configured to deaerate the first flow path and the second flow path.

This allows removal of air bubbles in the first flow path and the second flow path.

A method of the invention for printing uses a printing apparatus that includes a storage unit configured to store ink, a discharge unit to which the ink is supplied from the storage unit, the discharge unit being configured to discharge the ink for printing, and an ink flow path configured to couple the storage unit to the discharge unit and allow the ink to flow down from the storage unit to the discharge unit, wherein the ink flow path includes a first flow path, a first filter provided in the first flow path and configured to collect a foreign material in the ink passing through the first flow path, a second flow path independent of the first flow path, and a second filter configured to collect a foreign material in the ink passing through the second flow path. The method includes performing the printing, and switching the flow path between the first flow path and the second flow path during the printing based on a predetermined condition.

Such an arrangement enables switching of the flow path from the first flow path to the second flow path when the first filter is clogged during use of the first flow path, so that printing does not need to be discontinued. In addition, by switching to the second flow path, the first filter can be replaced even during printing by blocking the ink flow through the first low path.

According to the invention, even when one of the filters is clogged, printing can continue. This prevents decrease in the print efficiency.

DESCRIPTION OF EMBODIMENTS

A printing apparatus and a printing method according to an aspect of the invention will be described in detail below with reference to preferable exemplary embodiments illustrated in accompanying drawings.

First Exemplary Embodiment

Figure 1:
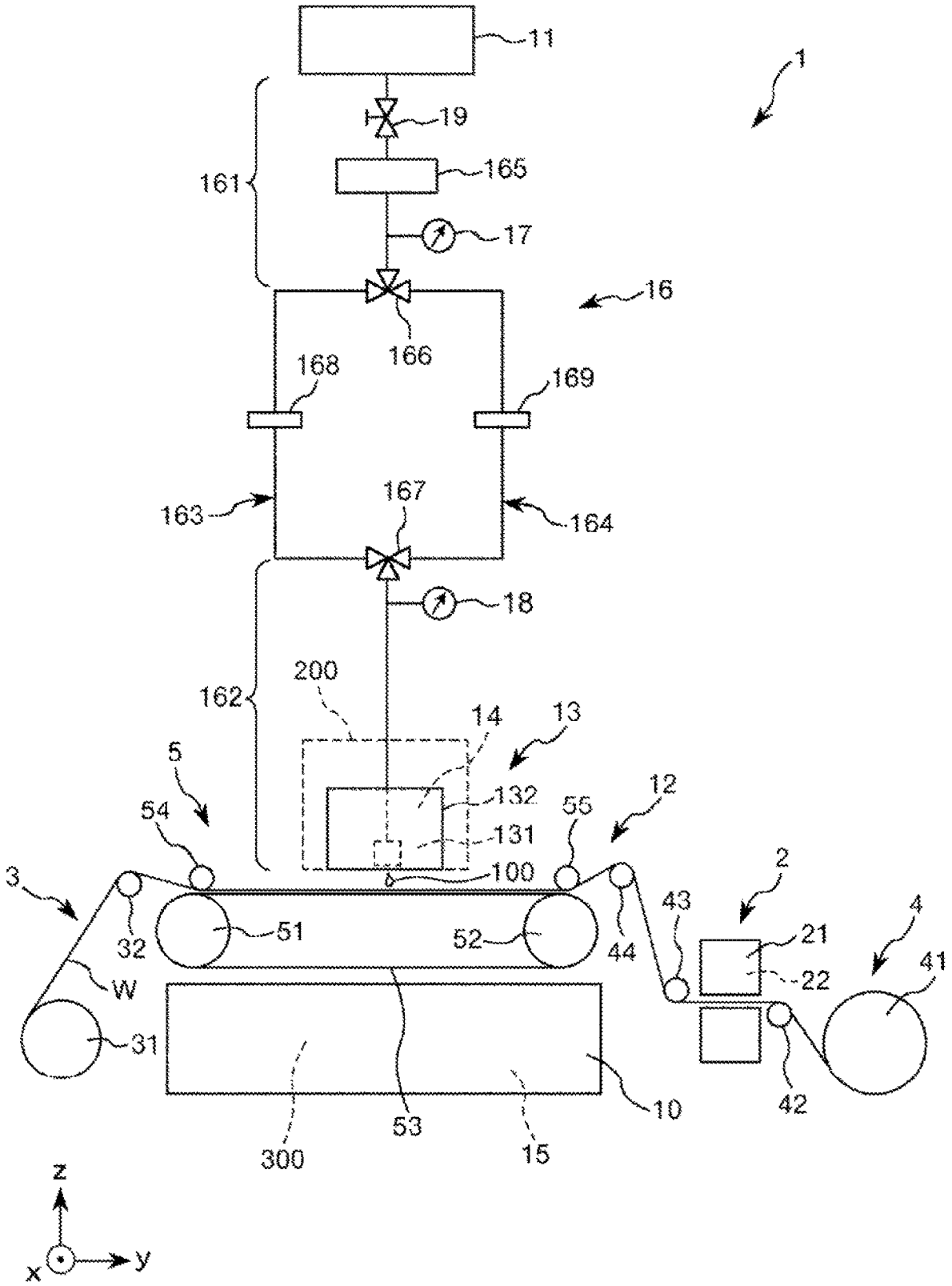
FIG. 1 illustrates a side view schematically illustrating a first exemplary embodiment of a printing apparatus according to the invention.
Figure 2:
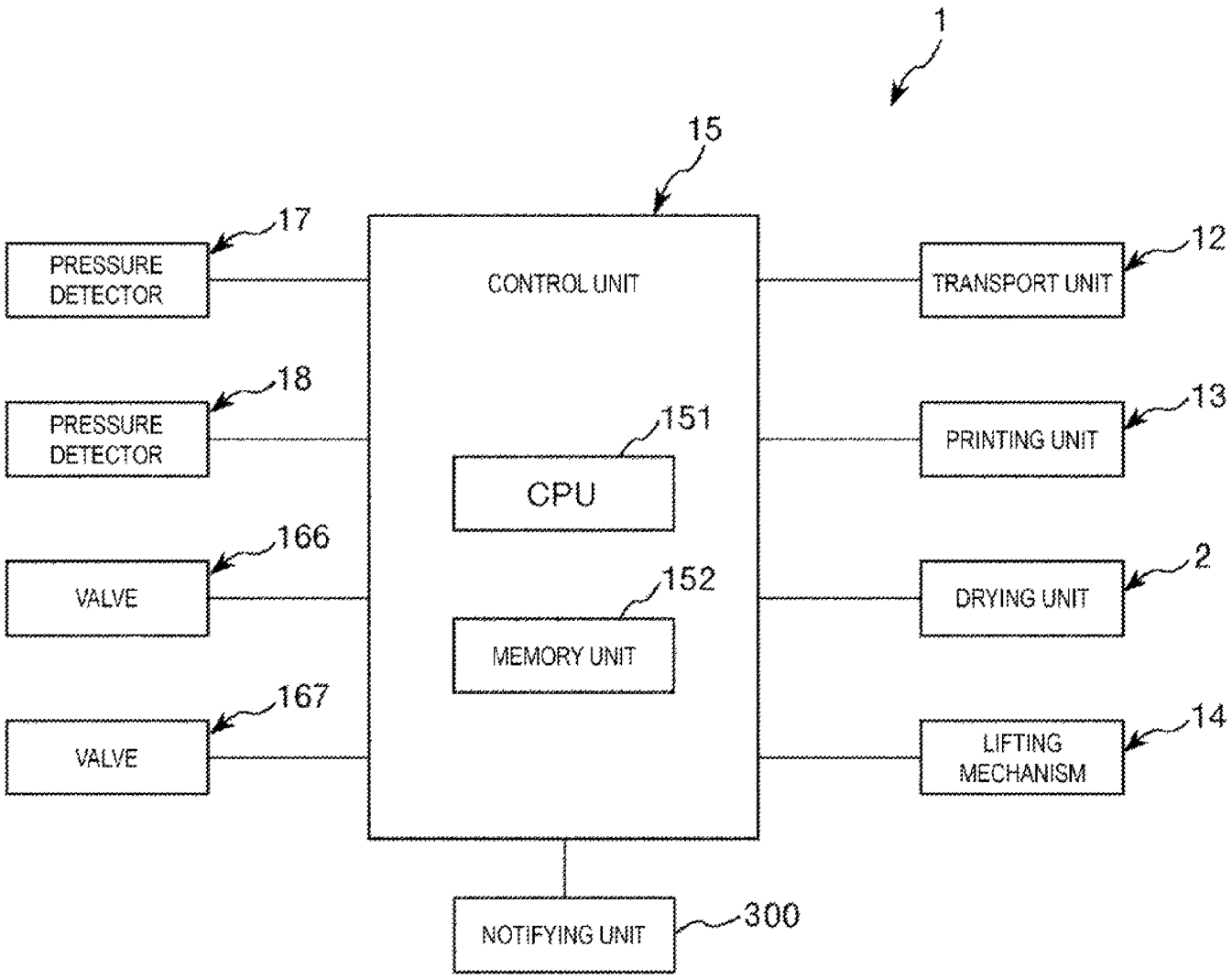
FIG. 2 illustrates a block diagram of the printing apparatus illustrated in FIG. 1.
Figure 3:
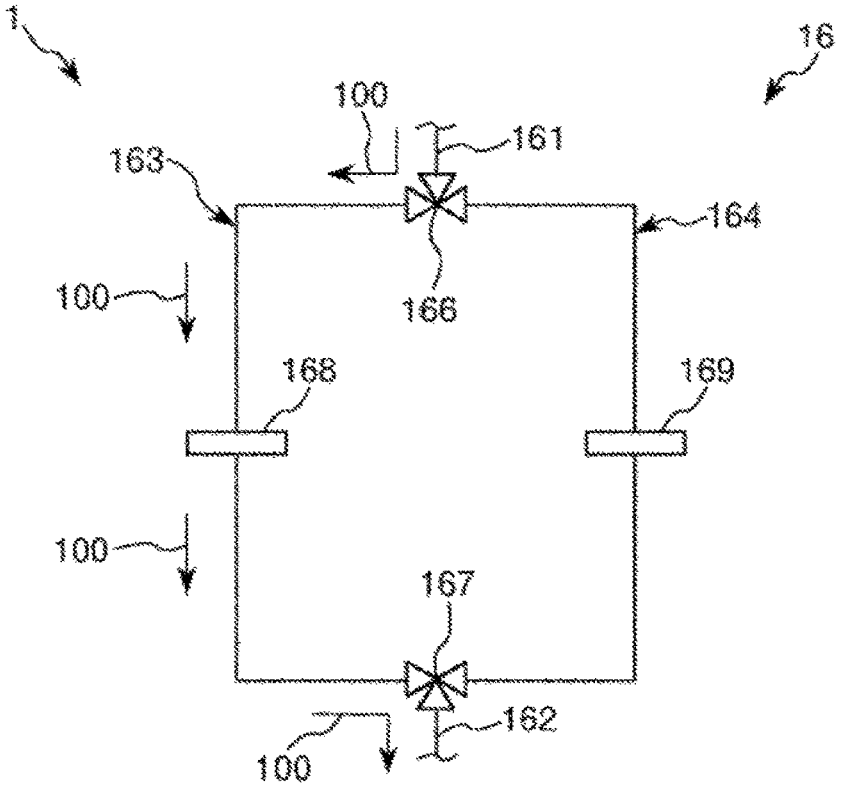
FIG. 3 illustrates a partially enlarged schematic diagram of an ink flow path included in the printing apparatus illustrated in FIG. 1, and indicates a state in which ink flows down in a first flow path.
Figure 4:
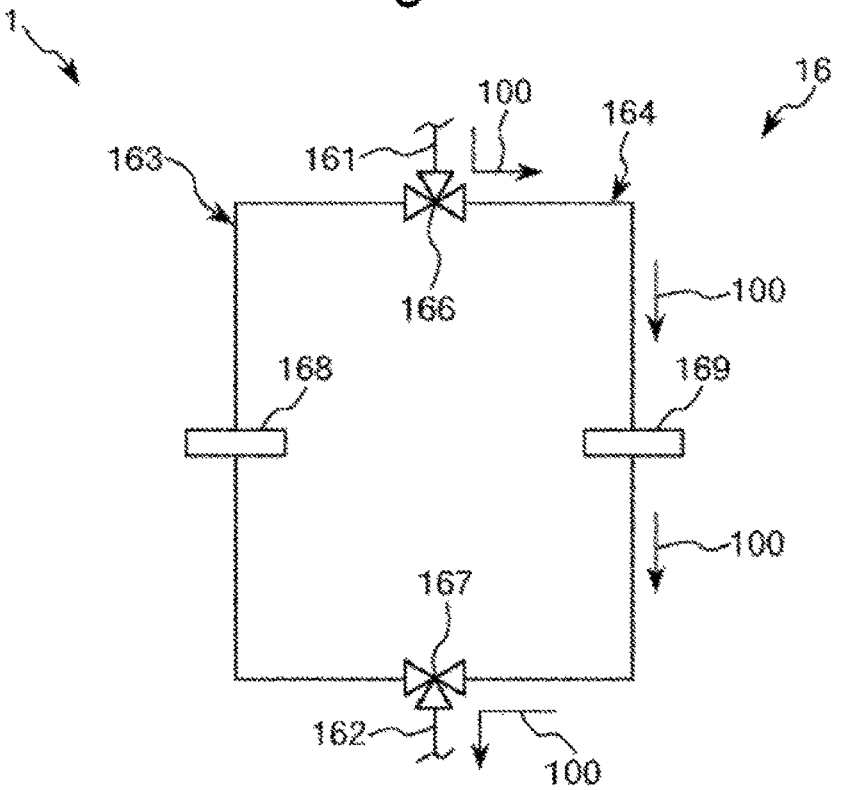
FIG. 4 illustrates a partially enlarged schematic diagram of the ink flow path included in the printing apparatus illustrated in FIG. 1, and indicates a state in which the ink flow path is switched to a second flow path so that ink flows down in the second flow path.
Figure 5:
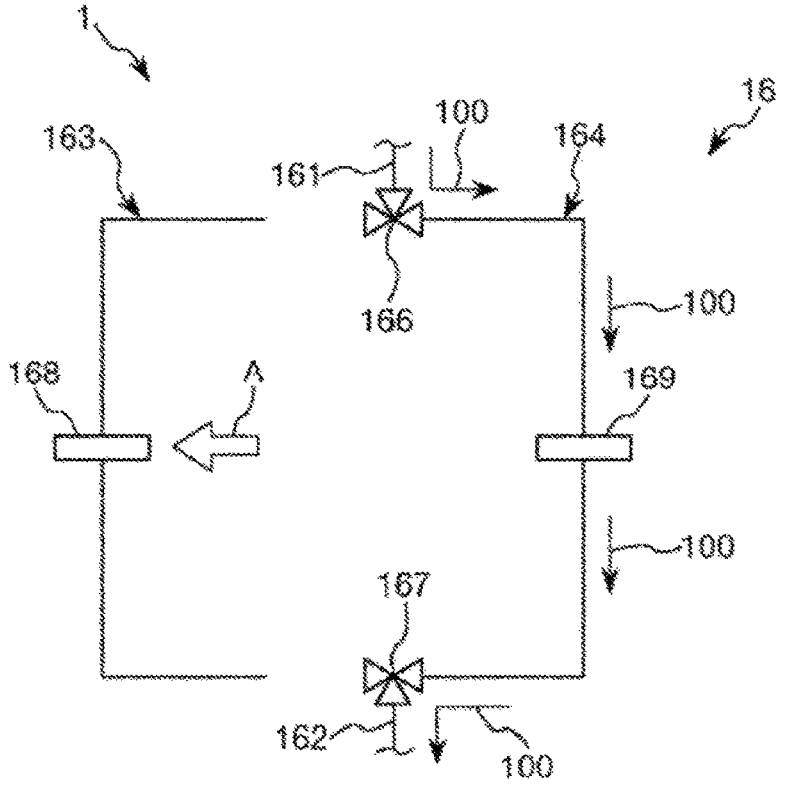
FIG. 5 illustrates a partially enlarged schematic diagram of the ink flow path included in the printing apparatus illustrated in FIG. 1, and indicates a state in which the first flow path is removed.
Figure 6:
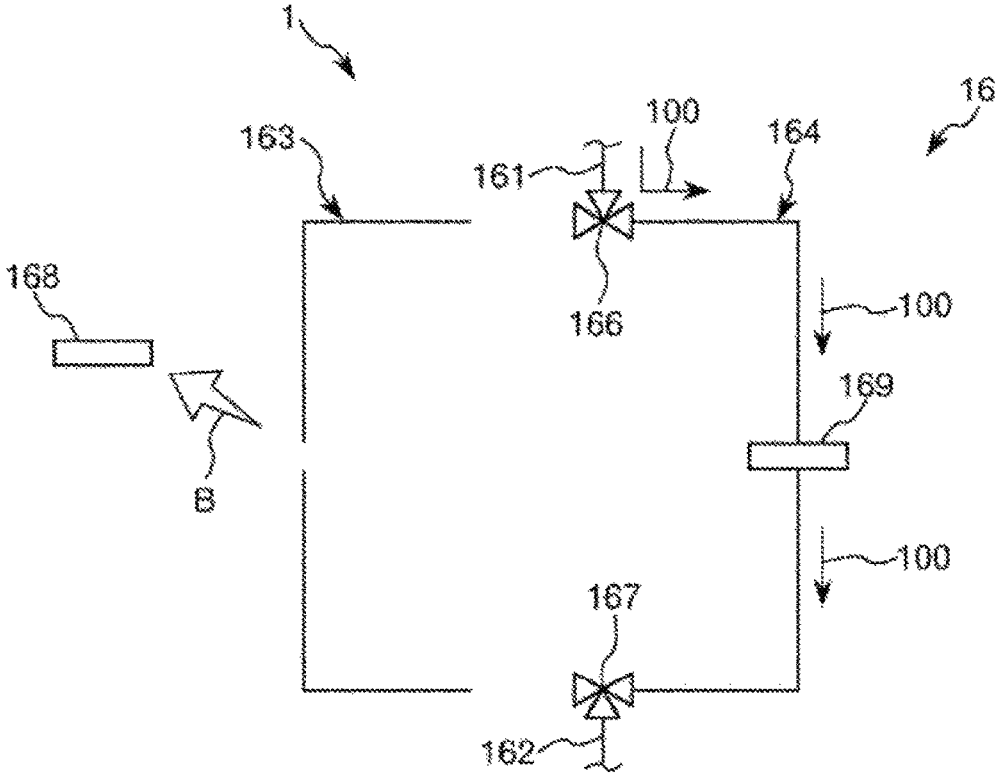
FIG. 6 illustrates a partially enlarged schematic diagram of the ink flow path included in the printing apparatus illustrated in FIG. 1, and indicates a state in which the first filter is removed.
Figure 7:
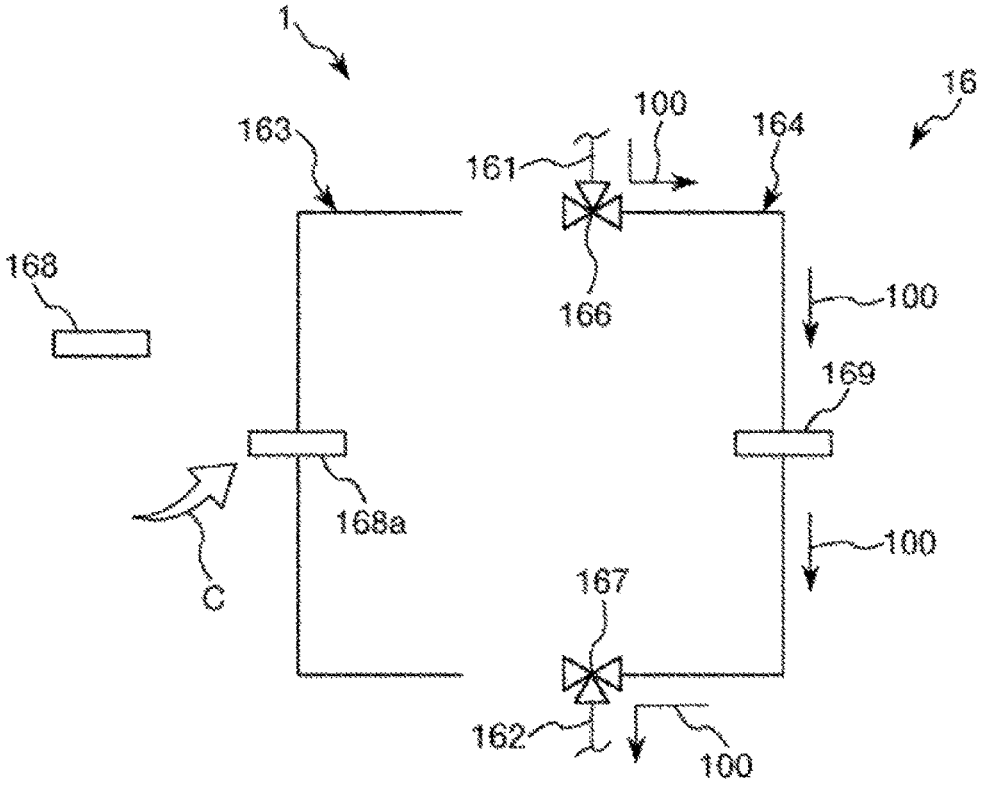
FIG. 7 illustrates a partially enlarged schematic diagram of the ink flow path included in the printing apparatus illustrated in FIG. 1, and indicates a state in which the first filter is replaced with a new filter.
Figure 8:
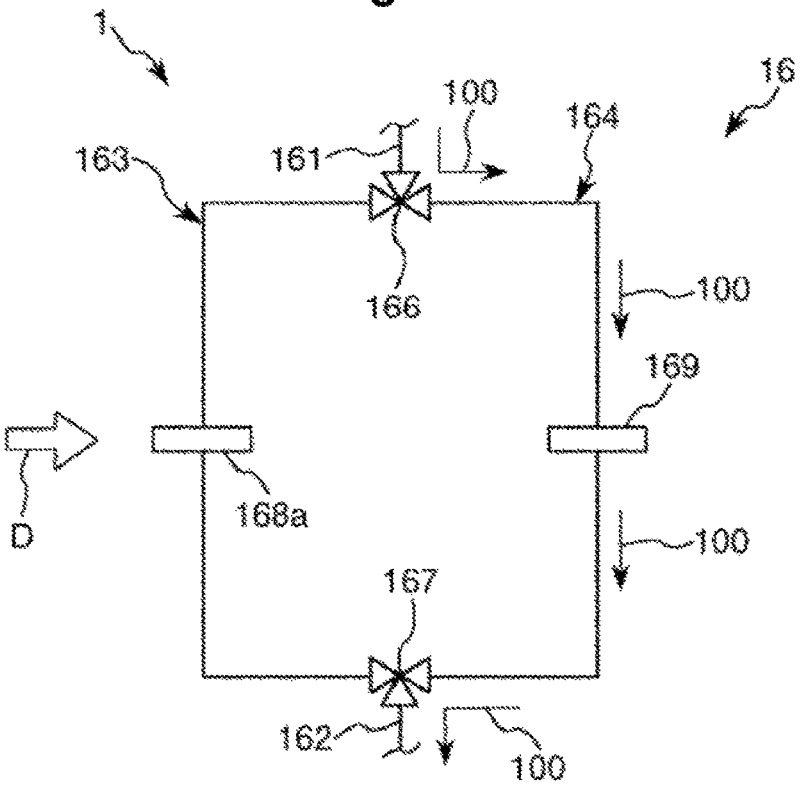
FIG. 8 illustrates a partially enlarged schematic diagram of the ink flow path included in the printing apparatus illustrated in FIG. 1, and indicates a state in which the first flow path is attached.
Figure 9:
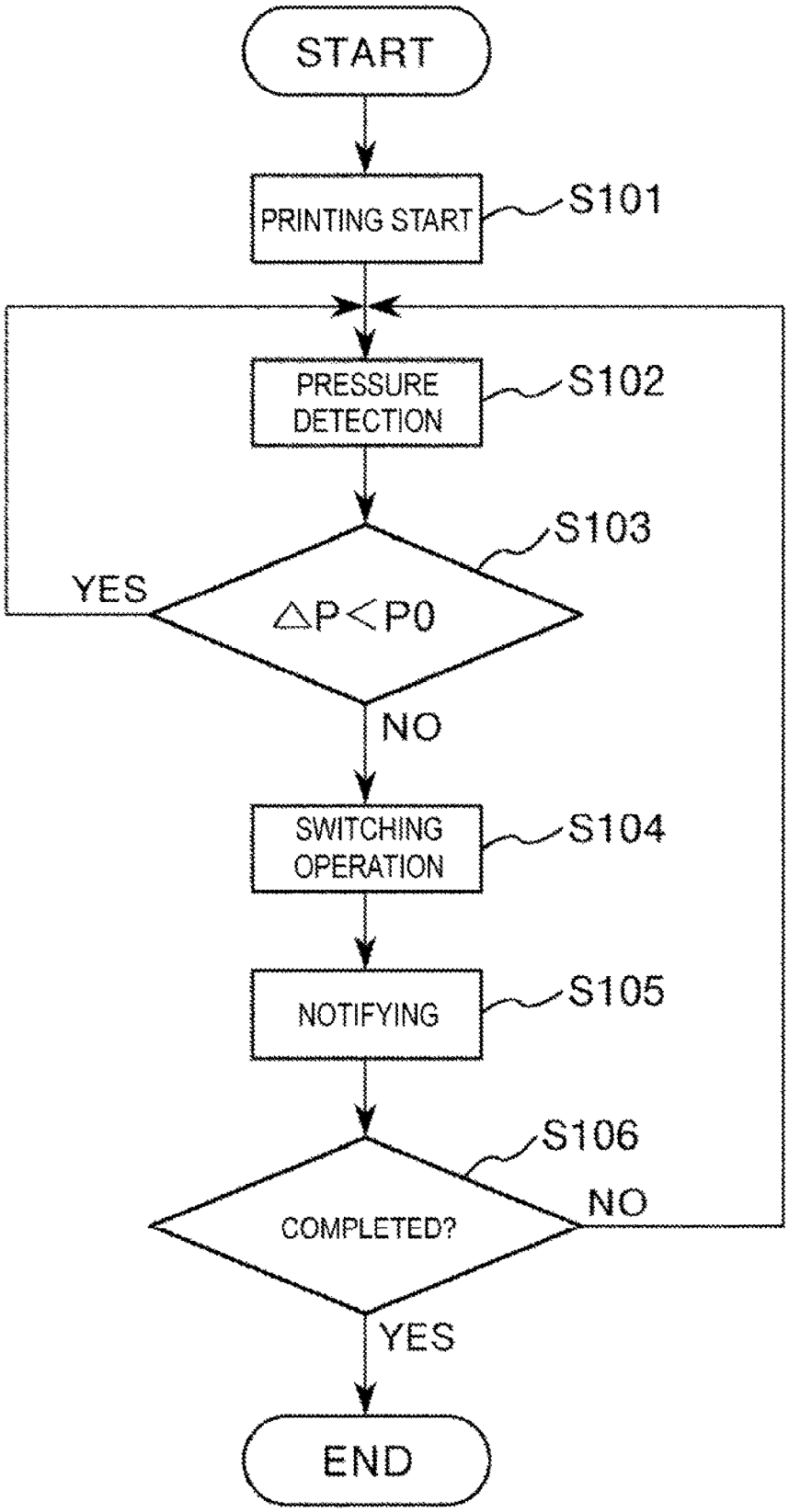
FIG. 9 illustrates a flowchart depicting control operations by a control unit included in the printing apparatus illustrated in FIG. 1.

FIG. 1 illustrates a side view schematically illustrating a first exemplary embodiment of a printing apparatus according to the invention. FIG. 2 illustrates a block diagram of the printing apparatus illustrated in FIG. 1. FIG. 3 illustrates a partially enlarged schematic diagram of an ink flow path included in the printing apparatus illustrated in FIG. 1, and indicates a state in which ink flows down through a first flow path. FIG. 4 illustrates a partially enlarged schematic diagram of the ink flow path included in the printing apparatus illustrated in FIG. 1, and indicates a state in which the ink flow path is switched to a second flow path so that ink flows down through the second flow path. FIG. 5 illustrates a partially enlarged schematic diagram of the ink flow path included in the printing apparatus illustrated in FIG. 1, and indicates a state in which the first flow path is removed. FIG. 6 illustrates a partially enlarged schematic diagram of the ink flow path included in the printing apparatus illustrated in FIG. 1, and indicates a state in which the first filter is removed. FIG. 7 illustrates a partially enlarged schematic diagram of the ink flow path included in the printing apparatus illustrated in FIG. 1, and indicates a state in which the first filter is replaced with a new filter. FIG. 8 illustrates a partially enlarged schematic diagram of the ink flow path included in the printing apparatus illustrated in FIG. 1, and indicates a state in which the first flow path is attached. FIG. 9 illustrates a flowchart depicting control operations by a control unit included in the printing apparatus illustrated in FIG. 1.

Note that, for the sake of convenience of description below, an x-axis, a y-axis, and a z-axis are illustrated in FIG. 1 as three axes perpendicular to each other. The x-axis extends along one direction of horizontal directions which is a width direction of the printing apparatus, or a depth direction in FIG. 1. The y-axis extends along a horizontal direction perpendicular to the x-axis, which corresponds to a longitudinal direction of the printing apparatus. The z-axis extends along a vertical direction, or an up-and-down direction. Additionally, a point side of each illustrated arrow is referred to as a "positive side" or "plus side", and a base end side is referred to as a "negative side" or "minus side". In addition, an upper side in FIG. 1 is referred to as "top (upward)" and a lower side is referred to as "bottom (downward)".

Moreover, in this specification, a motion of ink flowing from upstream to downstream is referred to as "ink flows down" and the direction along which the ink flows down may not necessarily coincide with the direction of gravity. That is, whether or not the direction along which the ink flows down coincides with the direction of gravity, the motion of the flowing ink may be referred to as "flow down".

A printing apparatus 1 illustrated in FIG. 1 includes a storage unit 11 configured to store ink 100, a printing unit 13 to which ink 100 is supplied from the storage unit 11 and that serves as a discharge unit configured to discharge the supplied ink 100 for printing, and an ink flow path 16 configured to couple the storage unit 11 to the printing unit 13 and to allow the ink 100 to flow down from the storage unit 11 to the printing unit 13.

Additionally, the ink flow path 16 includes a first branch flow path 163 to serve as a first flow path, a filter 168 arranged in the first branch flow path 163 and configured to collect a foreign material in the ink 100 passing through the first branch flow path 163, a second branch flow path 164 separate from the first branch flow path 163, and a filter 169 configured to collect the foreign material in the ink 100 passing through the second branch flow path 164.

The printing apparatus 1 is configured to switch the flow path of the ink 100 between the first branch flow path 163 and the second branch flow path 164 based on a predetermined condition.

With such an arrangement, the printing apparatus 1 enables switching from the first branch flow path 163 to the second branch flow path 164 when the filter 168 is clogged during use of the first branch flow path 163, so that printing does not need to be discontinued. In addition, by switching to the second branch flow path 164, the filter 168 can be replaced with a new one even during printing by blocking the ink flow through the first branch flow path 163.

Each unit of the printing apparatus 1 will be described in detail below.

As illustrated in FIG. 1, the printing apparatus 1 includes a machine base 10, the storage unit 11, the printing unit 13 configured to discharge the ink 100 supplied from the storage unit 11 on a work W as a recording medium for printing, the ink flow path 16 configured to couple the storage unit 11 to the printing unit 13, a transport unit 12 configured to transport the work W, a drying unit 2 configured to dry the ink 100 on the work W, a lifting mechanism 14, and a control unit 15.

In this exemplary embodiment, a direction perpendicular to a transport direction along which the work W is transported is an x-axis direction, a direction parallel to the transport direction is a y-axis direction, and a direction perpendicular to the x-axis and the y-axis is a z-axis direction.

The storage unit 11 is configured to independently store different colors of the ink 100. The ink 100 includes four colors, such as cyan, magenta, yellow, and black, each containing a dye or a pigment as a coloring material in water as a solvent.

The transport unit 12 includes a feeding device 3 configured to feed a web of work W wound into a roll, a winding device 4 configured to wind the printed work W, and a supporting device 5 disposed on the machine base 10 and configured to support the work W during printing.

The feeding device 3 is disposed on an upstream side in a feeding direction of the work W from the machine base 10, that is, on an upstream side in the y-axis direction. The feeding device 3 includes a feeding roller 31 configured to wind the work W into a roll and feed the work W, and a tensioner 32 configured to apply tension to the work W between the feeding roller 31 and the supporting device 5. The feeding roller 31 is coupled with a motor (not illustrated) and can rotate by an operation of the motor.

A printable material can be used as the work W. The term "printable material" refers to a fabric, a garment, and other clothing products which can be printed. Fabrics includes natural fibers such as cotton, silk and wool, chemical fibers such as nylon, or composite fibers of natural fibers and chemical fibers such as woven cloths, knit fabrics, and non-woven cloths. Garments and other clothing products include sewn products, such as a T-shirt, handkerchief, scarf, towel, handbag, fabric bag, and furniture-related products including a curtain, sheet, and bed cover, as well as fabric before and after cutting to serve as parts before sewing.

Note that, in addition to the above-described printable materials, special paper and the like for ink-jet recording, such as plain paper, pure paper, and glossy paper can be used as the work W. Other substrates that can be used as the work W include, for example, plastic films without a surface treatment applied to serve as an ink absorption layer for ink-jet printing, as well as substrates such as paper having a plastic coating applied thereon and substrates having a plastic film bonded thereto. Such plastic materials include, but are not limited to, for example, polyvinyl chloride, polyethylene terephthalate, polycarbonate, polystyrene, polyurethane, polyethylene, and polypropylene.

The winding device 4 is arranged downstream of the machine base 10 along the feeding direction of the work W with respect to the feeding device 3, or in other words, downstream along the y-axis direction. The winding device 4 includes a winding roller 41 configured to wind the work W into a roll, and a tensioner 42, a tensioner 43, and a tensioner 44 each configured to apply tension to the work W between the winding roller 41 and the supporting device 5. The winding roller 41 is coupled with a motor (not illustrated) and can rotate by an operation of the motor. The tensioners 42 to 44 are arranged in this order and are spaced apart along a direction away from the winding roller 41.

The supporting device 5 is disposed between the feeding device 3 and the winding device 4. The supporting device 5 includes a main driving roller 51 and a driven roller 52 separately disposed from each other in the y-axis direction, an endless belt 53 stretching around the main driving roller 51 and the driven roller 52 and configured to support the work W on its upper surface, and tensioners 54 and 55 configured to apply tension to the work W between the main driving roller 51 and the driven roller 52.

The main driving roller 51 is coupled with a motor (not illustrated) and can rotate by an operation of the motor. The driven roller 52 can rotate along with the main driving roller 51 as the rotating force of the main driving roller 51 is transmitted via the endless belt 53 to the driven roller.

The endless belt 53 is a belt having an adhesive layer formed on the outer surface thereof. A part of the work W is adhesively fixed to the adhesive layer and is transported in the y-axis direction. The work W is then printed as it is transported. The printed work W then separates from the endless belt 53.

Similar to the main driving roller 51 and the driven roller 52, the tensioner 54 and the tensioner 55 are arranged apart from each other along the y-axis direction.

The main driving roller 51 and the main driving roller 51 can hold the work W and the endless belt 53 therebetween while the tensioner 55 and the driven roller 52 can hold the work W and the endless belt 53 therebetween. Thus, the work W tensioned by the tensioner 54 and the tensioner 55 is transported while being fixed on the endless belt 53 and tensioned. This helps reduce wrinkling of the work W during transportation, for example, such that accurate and high-quality printing is ensured when the work W is printed.

The above-mentioned transport unit 12 is electrically coupled with the control unit 15, as illustrated in FIG. 2, to control its operation.

The printing unit 13 includes a carriage unit 132 including a plurality of nozzles 131 configured to discharge the ink 100 on the work W and to record by printing and an x-axis table (not illustrated) configured to support the carriage unit 132 movably in the x-axis direction.

Additionally, the printing unit 13 includes a piezoelectric element corresponding to each nozzle 131, such that when a voltage is applied to the piezoelectric element, the ink 100 is discharged from each nozzle 131 as droplets. The above-mentioned printing unit 13 is electrically coupled with the control unit 15 to control such operation.

In the printing apparatus 1, the work W fed by the feeding device 3 is intermittently fed as sub-scanning in the y-axis direction in a fixed state with the work W adhesively fixed to the endless belt 53, and the ink 100 is discharged to the work W in the fixed state from the nozzle 131 while the carriage unit 132 is made to reciprocate in the x-axis direction, as main scanning. This can be performed until printing is completed and an image pattern is formed on the work W. Note that the image pattern may be formed by multicolor printing or monochrome printing.

The lifting mechanism 14 illustrated in FIG. 1 can adjust the height of the nozzle 131. For example, the lifting mechanism 14 can be configured to include a motor, a ball screw and a linear guide. The motor incorporates an encoder. The height of the nozzle 131 can be detected based on the amount of rotation detected by the encoder. The above-mentioned lifting mechanism 14 is also electrically coupled with the control unit 15, as illustrated in FIG. 2, to control its operation.

As illustrated in FIG. 1, the drying unit 2 is disposed downstream of the printing unit 13 and between the supporting device 5 and the winding roller 41 of the winding device 4 along the transport direction of the work W.

The drying unit 2 includes a chamber 21 and a coil 22 disposed in the chamber 21. The coil 22 is formed of a nichrome wire, for example, and serves as a heat element that generates heat when supplied with power. The heat generated by the coil 22 can dry the ink 100 on the work W as it passes through the chamber 21.

As illustrated in FIG. 2, the control unit 15 includes a Central Processing Unit (CPU) 151 and a memory unit 152.

The CPU 151 executes programs for various kinds of processing, such as printing processing described above.

The memory unit 152 can include, for example, an Electrically Erasable Programmable Read-Only Memory (EEPROM), which is a type of nonvolatile semiconductor memories, and can store the various kinds of programs and the like.

A notifying unit 300, as described below, informs when a filter 168 or a filter 169 is clogged. The notifying unit 300, for example, is configured to include a buzzer, a monitor, a lamp and the like. This can prompt an operator to replace the filter 168 or the filter 169.

Next, the ink flow path 16 will be described.

The ink flow path 16 couples the storage unit 11 to the nozzle 131. The ink 100 flows through the ink flow path 16 from the storage unit 11 to the nozzle 131.

The ink flow path 16 includes an upstream flow path 161, a downstream flow path 162, the first branch flow path 163 as the first flow path, the second branch flow path 164 as the second flow path, a sub-storage unit 165, a valve 166, a valve 167, the filter 168 as the first filter, the filter 169 as the second filter, a pressure detector 17, and a pressure detector 18.

The upstream flow path 161 is positioned on a side of the storage unit 11. The downstream flow path 162 is positioned on a side of the nozzle 131. The first branch flow path 163 and the second branch flow path 164 are positioned between the upstream flow path 161 and the downstream flow path 162. In other words, the ink flow path 16 branches into the first branch flow path 163 and the second branch flow path 164, which in turn meet downstream of a branch point of the first branch flow path 163 and the second branch flow path 164. In this arrangement, for example, the number of valves that need to be switched, as well as the number of connections between the ink flow path 16 and the storage unit 11 or the nozzle 131, can be reduced as compared to an arrangement in which two independent flow paths connect the storage unit 11 and the nozzle 131 and are switched from one to the other. This enables a simple arrangement of the printing apparatus 1.

Note that, as illustrated in FIGS. 5 to 7, the first branch flow path 163 with the filter 168 is configured to be removable from the valve 166 at the branch point and from the valve 167 at the junction. While the first branch flow path 163 is illustrated removed in FIGS. 5 to 7, the second branch flow path 164 with the filter 169 is also configured to be removable from the valve 166 and the valve 167 as is the first branch flow path 163.

The sub-storage unit 165 is provided in the upstream flow path 161. The sub-storage unit 165 is a unit that temporarily stores the ink 100 that flows down from the storage unit 11.

In addition, an electromagnetic valve 19 is provided in the upstream flow path 161 between the storage unit 11 and the sub-storage unit 165. The electromagnetic valve 19 opens and closes the upstream flow path 161 to allow and terminate the supply of the ink 100 from the storage unit 11 to the sub-storage unit 165. The electromagnetic valve 19 is electrically coupled with the control unit 15, as illustrated in FIG. 2, to control its operation.

The valve 166 is positioned at the boundary between the upstream flow path 161 and the first branch flow path 163 and the second branch flow path 164 (i.e., at the branch point). The valve 167 is positioned at the boundary between the downstream flow path 162 and the first branch flow path 163 and the second branch flow path 164 (i.e., at the junction).

The valve 166 and the valve 167 are switching units that switch between whether the ink 100 flowing down through the upstream flow path 161 flows through the first branch flow path 163 before flowing into the downstream flow path 162 or the ink 100 flows through the first branch flow path 163 before flowing into the downstream flow path 162.

The valve 166 and valve 167 are electrically coupled with the control unit 15, as illustrated in FIG. 2, to control their operation.

The filter 168 is provided in the first branch flow path 163 and the filter 169 is provided in the second branch flow path 164. The filter 168 and the filter 169 have the same arrangement, so that the filter 168 will be representatively described below.

The filter 168 serves to collect foreign materials in the ink 100 passing through the first branch flow path 163. The filter 169 serves to catch foreign materials in the second branch flow path 164. The foreign material in the ink 100 as used herein means, for example, a precipitated solid component in the ink 100, dust mixed in the ink 100, or the like, while it may depend on the composition of the ink 100, These filters 168, 169 are formed of, for example, a sheet material with many micropores formed by knitted wires of metal material. The micropores allow the passage of the ink 100 therethrough while preventing the passage of foreign materials to provide the above-described function of the filters 168, 169.

The pressure detector 17 is arranged in the ink flow path 16 upstream of the filter 168 and the filter 169, that is, in the upstream flow path 161. It serves as an upstream pressure detection unit for detecting pressure in the upstream flow path 161. The pressure detector 18 is arranged in the ink flow path 16 downstream of the filter 168 and the filter 169. It serves as a downstream side pressure detection unit for detecting pressure in the ink flow path 16. The pressure detectors 17, 18 enables detection of the pressure in the upstream flow path 161 and the downstream flow path 162.

In an existing printing apparatus, an ink flow path corresponding to each ink type is provided between a storage unit and a nozzle and a filter is provided in each ink flow path. When foreign materials accumulate in the filter to necessitate replacement of the filter, printing operation needs to be terminated to replace the filter. This leads to a decreased print efficiency. On the other hand, the invention eliminates this drawback. This will be described in detail below with reference to FIGS. 3 to 8.

FIG. 3 illustrates a diagram depicting a printing state in which the printing apparatus 1 is printing. In the printing state, as one example, the ink 100 passes through the upstream flow path 161, through the first branch flow path 163 and to the downstream flow path 162 and is then supplied to the nozzle 131 illustrated in FIG. 1. Since the ink 100 is not flowing through the second branch flow path 164, the filter 169 remains in a new condition with no foreign materials accumulated therein, while the second branch flow path 164 is filled with the ink 100.

As the ink 100 flowing down the first branch flow path 163 passes through the filter 168, foreign materials are collected by the filter 168. As a result, the ink 100 discharged from the nozzle 131 as illustrated in FIG. 1 does not contain foreign materials and thus, the clogging of the nozzle 131 can be prevented.

As the filter 168 collects the foreign materials, the foreign materials accumulated on the filter 168 may clog the filter 168. In the printing apparatus 1, the first branch flow path 163 and the second branch flow path 164 are switched from one to the other based on the pressure detected by the pressure detector 17 and the pressure detected by the pressure detector 18. This makes it possible to know precisely when the filter 168 and the filter 169 are to be replaced.

In the printing apparatus 1, when the clogging of the filter 168 is detected, the valve 166 and the valve 167 are operated to switch the flow of the ink 100 to the second branch flow path 164. Thus, the ink 100 now passes through the new filter 169 that continuously collect foreign materials. In this manner, the printing apparatus 1 enables switching operation from the clogged filter 168 to the new filter 169 without terminating the supply of the ink 100 from the storage unit 11 to the nozzle 131. Accordingly, even when the filter 168 is clogged during printing, the printing operation does not have to be terminated due to this switching operation. This prevents decrease in the print efficiency.

After the switching operation is performed by the printing apparatus 1, operator performs a replacement operation to replace the clogged filter 168 to a new filter **168*a*. First, as illustrated by an arrow A in FIG. 5, the first branch flow path 163 is removed from the valve 166 and the valve 167. Upon this, operator can discharge the ink 100 remaining in the first branch flow path 163**.

Next, as illustrated by an arrow B in FIG. 6, the filter 168 is removed and the new filter **168*a* is attached in place as illustrated by an arrow C in FIG. 7. With the filter 168*a* attached, the first branch flow path 163 is attached to the valves 166, 167 again as illustrated by an arrow D in FIG. 8**.

Thus, in the printing apparatus 1, the filter 168 is removable from the first branch flow path 163 and the filter 169 is removable from the second branch flow path 164. This allows each of the filter 168 and the filter 169 to be replaced with a new filter.

Additionally, in the printing apparatus 1, the first branch flow path 163 is removable together with the filter 168 and the second branch flow path 164 is removable together with the filter 169. Thus, the replacement operation is performed with the first branch flow path 163 or the second branch flow path 164 removed. This facilitates the replacement operation.

As illustrated in FIG. 1, the printing apparatus 1 includes a movable unit 200. The movable unit 200 includes the printing unit 13 and part of the downstream flow path 162 and is movable in a case of printing. In the printing apparatus 1, as illustrated in FIG. 1, the filter 168, the filter 169, the first branch flow path 163 and the second branch flow path 164 are located apart from the movable unit 200, that is, upstream of the movable unit 200. With this arrangement, the filter 168, the filter 169, the first branch flow path 163 and the second branch flow path 164 will not move whether or not the movable unit 200 is moving. Accordingly, the replacement operation can be performed whether printing is in operation or out of operation. In other words, whether or not the printing apparatus 1 is in operation, the replacement of the filter 168 and the filter 169 can be performed while the first branch flow path 163 and the second branch flow path 164 are not in operation.

In addition, in the printing apparatus 1, when the switching between the first branch flow path 163 and the second branch flow path 164 is performed during printing, the printing operation does not have to be terminated to perform the replacement operation. This prevents decrease in the print efficiency.

The phrase "printing is out of operation" as used herein not only includes the time during which printing is not performed, but also the time during which the printing unit 13 is not operating even during the printing operation, such as the time during which the printing unit 13 stops where it turns around during the reciprocating operation or the time during which it stops during the intermittent feeding.

Moreover, for example, in a case where the ink 100 is of a type that tends to form a solid precipitate when shaken, foreign materials are more likely to form in the movable unit 200. In this case, although not illustrated, the filter 168, the filter 169, the first branch flow path 163, and the second branch flow path 164 are preferably included in the movable unit 200. In other words, the filter 168, the filter 169, the first branch flow path 163, and the second branch flow path 164 are preferably configured to move along with the movable unit 200. In this manner, any foreign material formed in the movable unit 200 can be readily collected by the filter 168 or the filter 169.

In addition, in the arrangement in which the filter 168, the filter 169, the first branch flow path 163 and the second branch flow path 164 are included in the movable unit 200, the replacement operation is preferably performed while the movable unit 200 is not moving. With this arrangement, the replacement operation of the filter 168 or the filter 169 can be easily performed while the first branch flow path 163 and the second branch flow path 164 are not in operation.

Since the electromagnetic valve 19 tends to heat to a relatively high temperature, foreign materials are likely to form in the electromagnetic valve 19 when an ink that has tendency to form a solid precipitate at high temperature is used. Thus, the first branch flow path 163 and the second branch flow path 164 may be provided between the electromagnetic valve 19 and the sub-storage unit 165. In this manner, any foreign material formed in the electromagnetic valve 19 can be readily collected by the filter 168 or the filter 169.

Next, a control operation of the printing apparatus 1, namely, the printing method according to an aspect of the invention will be described with reference to the flowchart illustrated in FIG. 9. In the following description, a case will be described where the ink 100 passes through the upstream flow path 161, through the first branch flow path 163 and to the downstream flow path 162 and is then supplied to the nozzle 131 as in the case of the description above (see FIG. 3).

First, in a step S101, printing starts (a printing step).

Next, in a step S102, pressure P1 upstream of the filter 168 and pressure P2 downstream of the filter 168 are detected. Then, in the step S102, whether a pressure difference ΔP between the pressure P1 and the pressure P2 is smaller than a threshold value P0 is determined.

In a step S103, if ΔP is determined to be equal to or larger than P0, it is then determined that the filter 168 is clogged, and in a step S104, a switching operation is performed (a switching step). That is, the valve 166 and the valve 167 are switched to allow the ink 100 to pass through the second branch flow path 164 to be supplied to the nozzle 131 (see FIG. 4). In this manner, printing can be continued despite the clogged filter 168.

In a step S105, it is notified that clogging has occurred in the filter 168. In this manner, as described above, an operator can replace the filter 168 with the new filter 168*a* (see FIG. 5 to FIG. 8).

Then, in a step S106, whether printing has been completed is determined. If it is determined that printing has not been completed, then the process returns to the step S102 and sequentially repeats the subsequent steps.

As described above, the printing method according to an aspect of the invention is a printing method that is performed by using the printing apparatus 1, the printing method including a printing step of performing printing, and a switching step of switching the flow path of the ink 100 between the first branch flow path 163 and the downstream flow path 162 during the printing step, based on the pressure difference ΔP between the pressure P1 and the pressure P2, as a predetermined condition.

According to the printing method of the invention, even in a case that one of the filter 168 and the filter 169 is clogged, printing can continue. This prevents a decrease in the print efficiency.

Note that, in the above description, a case where the switching operation is performed based on the pressure difference ΔP between the pressure P1 and the pressure P2, as the predetermined condition, was described. However, the invention is not limited to such a case. For example, the switching operation may be performed, based on cumulative operation time of the printing apparatus 1 or a total discharge amount of the ink 100.

Second Exemplary Embodiment

Figure 10:
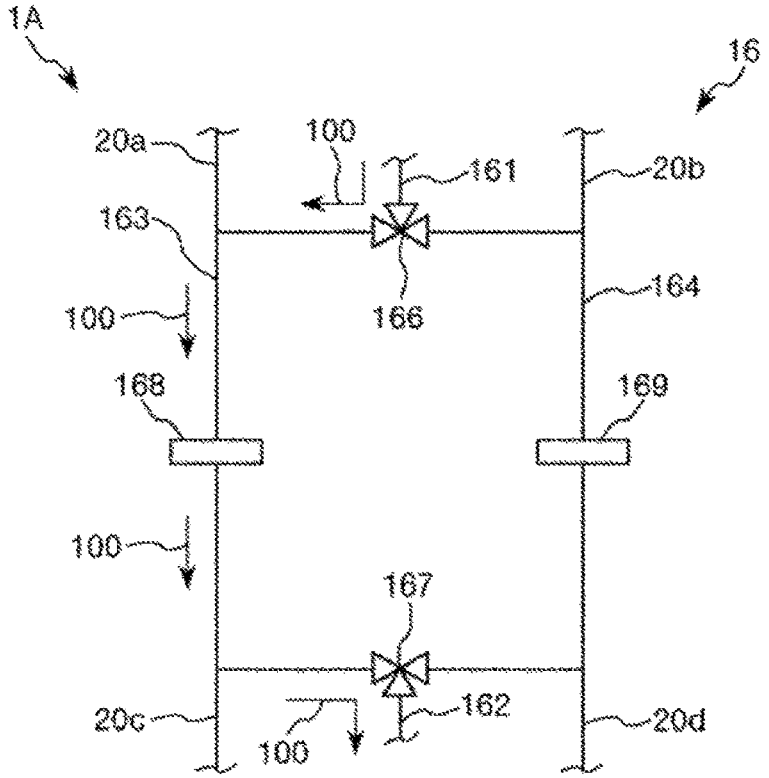
FIG. 10 illustrates a partially enlarged schematic diagram of an ink flow path included in a second exemplary embodiment of the printing apparatus according to the invention, and indicates a state in which ink flows down through a first flow path.
Figure 11:
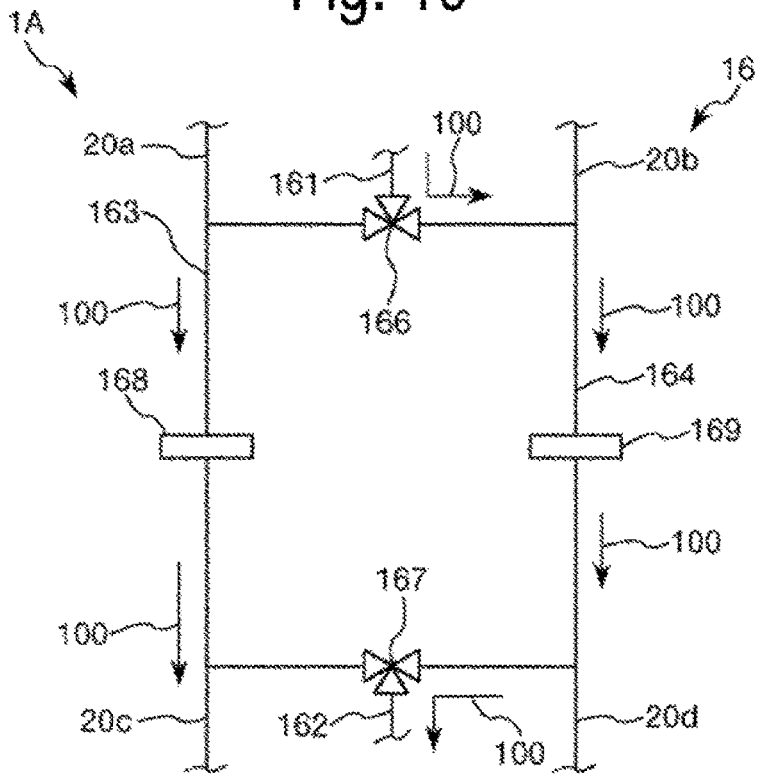
FIG. 11 illustrates a partially enlarged schematic diagram of the ink flow path included in the printing apparatus illustrated in FIG. 10, and indicates a state in which the ink flow path is switched to a second flow path so that ink flows down through the second flow path.
Figure 12:
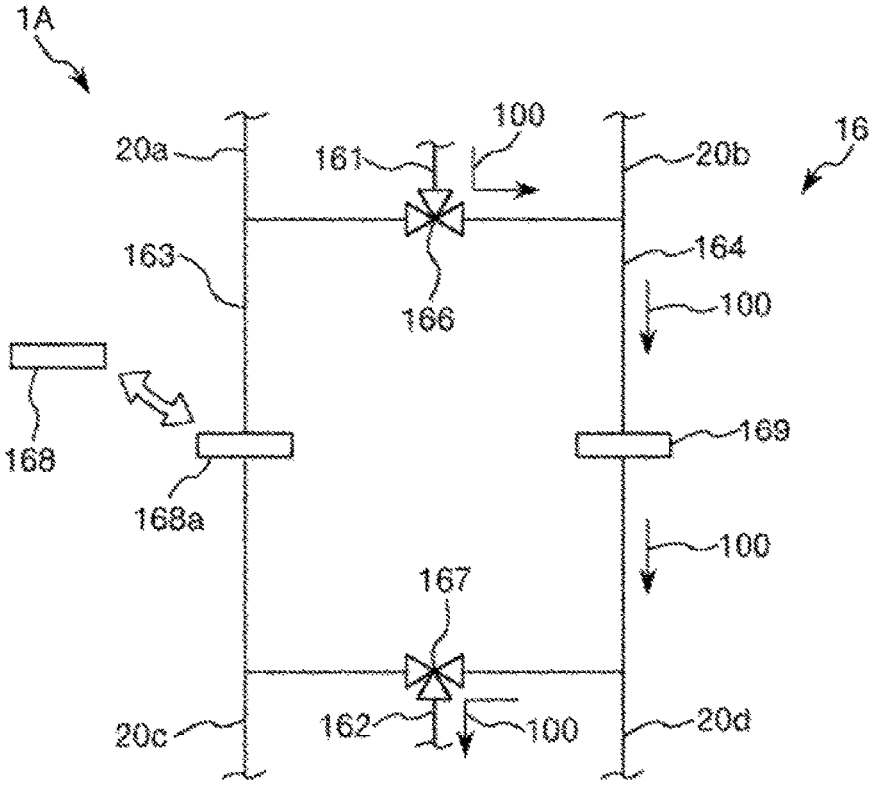
FIG. 12 illustrates a partially enlarged schematic diagram of the ink flow path included in the printing apparatus illustrated in FIG. 10, and indicates a state in which the first filter is replaced with a new filter.
Figure 13:
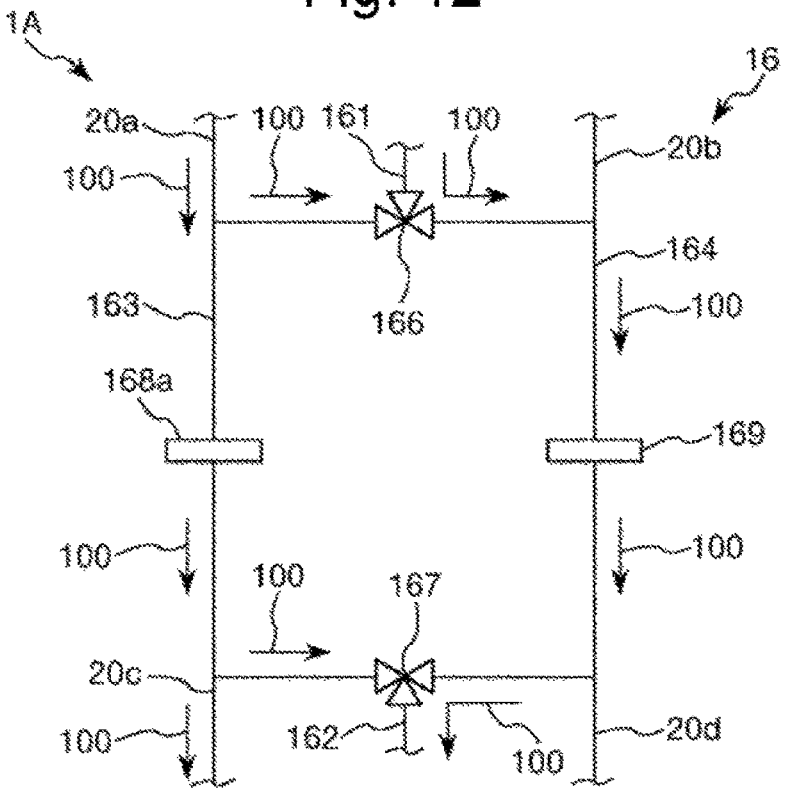
FIG. 13 illustrates a partially enlarged schematic diagram of the ink flow path included in the printing apparatus illustrated in FIG. 10, and indicates a state in which the ink is supplied to the first flow path.

FIG. 10 illustrates a partially enlarged schematic diagram of an ink flow path included in a second exemplary embodiment of the printing apparatus according to the invention, and indicates a state in which ink flows down through a first flow path. FIG. 11 illustrates a partially enlarged schematic diagram of the ink flow path included in the printing apparatus illustrated in FIG. 10, and indicates a state in which the ink flow path is switched to a second flow path so that ink flows down through the second flow path. FIG. 12 illustrates a partially enlarged schematic diagram of the ink flow path included in the printing apparatus illustrated in FIG. 10, and indicates a state in which the first filter is replaced with a new filter. FIG. 13 illustrates a partially enlarged schematic diagram of the ink flow path included in the printing apparatus illustrated in FIG. 10, and indicates a state in which the ink is supplied to the first flow path.

While the second exemplary embodiment of the printing apparatus according to the invention will be described below with reference to these drawings, a difference from the above-described exemplary embodiment will be mainly described and description of the same matters will be omitted.

This exemplary embodiment is substantially the same as the first exemplary embodiment, except that the ink flow path has a different arrangement.

In printing apparatus 1A illustrated in FIG. 10 to FIG. 13, the ink flow path 16 includes a replenishing flow path 20*a* and a replenishing flow path 20*b*, and a waste liquid flow path 20*c* and a waste liquid flow path 20*d* coupled with the first branch flow path 163 and the second branch flow path 164, respectively.

The replenishing flow path 20*a* couples the storage unit 11 to the first branch flow path 163 illustrated in FIG. 1. The replenishing flow path 20*a* is configured to replenish the ink 100 to the first branch flow path 163. The replenishing flow path 20*b* couples the storage unit 11 to the second branch flow path 164 illustrated in FIG. 1. The replenishing flow path 20*a* is configured to replenish the ink 100 to the second branch flow path 164.

The waste liquid flow path 20*c* is coupled with the first branch flow path 163. The waste liquid flow path 20*c* is configured to discharge the ink 100 in the first branch flow path 163. The waste liquid flow path 20*d* is coupled with the second branch flow path 164. The waste liquid flow path 20*d* is configured to discharge the ink 100 in the second branch flow path 164.

The replenishing flow path 20*a* and the waste liquid flow path 20*c* are coupled with the first branch flow path 163 via a valve not illustrated, such that a communicated state or a non-communicated state is controlled. The replenishing flow path 20*b* and the waste liquid flow path 20*d* are coupled with the second branch flow path 164 via a valve not illustrated, such that a communicated state or a non-communicated state is controlled.

Note that, a suction pump not illustrated is provided in the waste liquid flow path 20*c* and the waste liquid flow path 20*d* so that the ink 100 in the first branch flow path 163 and the second branch flow path 164 can be discharged by suction.

Next, operations of the printing apparatus 1A during printing will be described.

First, as illustrated in FIG. 10, the printing apparatus 1A is printing by using the first branch flow path 163.

Then, as illustrated in FIG. 11, in a case the filter 168 is clogged, printing is performed by switching from the first branch flow path 163 to the second branch flow path 164. After that, the ink 100 remaining in the first branch flow path 163 is discharged via the waste liquid flow path 20*c*. As a result, the first branch flow path 163 becomes empty, so that the ink 100 will not stick to operator's hand or spilled during the replacement operation of the filter 168 as illustrated in FIG. 12.

After the replacement operation from the filter 168 to the filter 168*a* is completed, the ink 100 is replenished to the first branch flow path 163 via the replenishing flow path 20*a* as illustrated in FIG. 13. With this arrangement, the first branch flow path 163 is filled with the ink 100 while the second branch flow path 164 is being used, so that in a case that the filter 169 in the second branch flow path 164 is clogged, switching to the first branch flow path 163 can be performed whenever necessary.

In particular, a new filter 168*a* has air trapped in the micropores that decreases the ability of the filter to collect foreign materials. Moreover, in a case that the air is discharged from the nozzle 131, printing quality tends to decrease. In the printing apparatus 1A, the micropores of the new filter 168*a* are filled with the ink 100, or the air is discharged from the micropores, and thus decrease in the ability of the filter to collect foreign materials, as well as decrease in the printing quality, can be prevented.

Third Exemplary Embodiment

Figure 14:
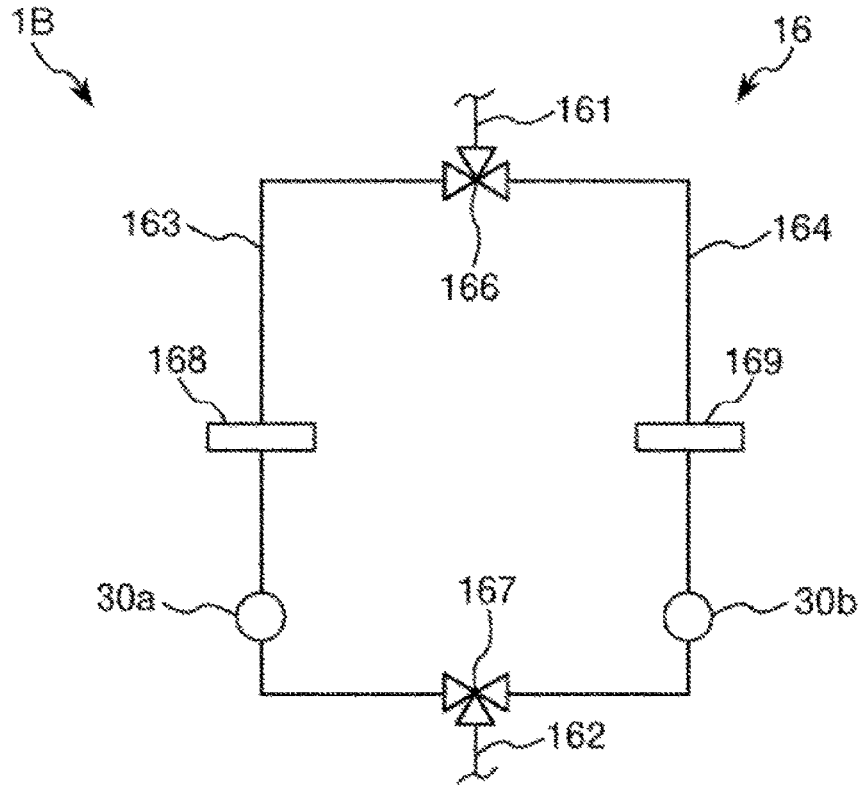
FIG. 14 illustrates a partially enlarged schematic diagram of an ink flow path included in a third exemplary embodiment of the printing apparatus according to the invention.
Figure 15:
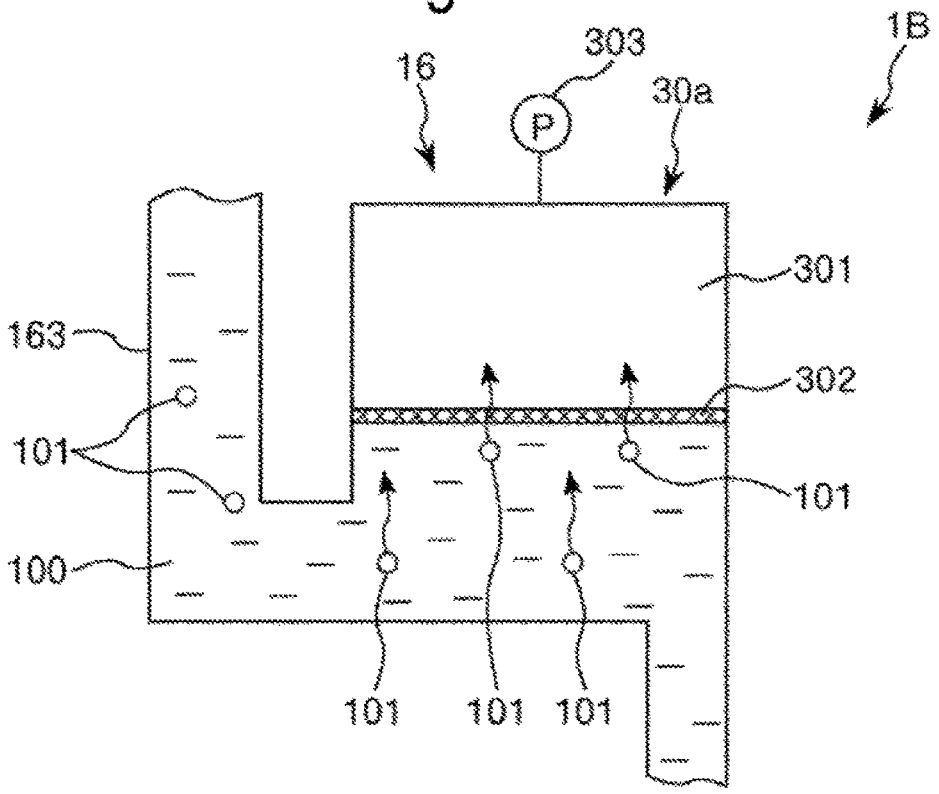
FIG. 15 illustrates a deaerating unit included in the ink flow path illustrated in FIG. 14.

FIG. 14 illustrates a partially enlarged schematic diagram of an ink flow path included in a third exemplary embodiment of the printing apparatus according to the invention. FIG. 15 illustrates a deaerating unit included in the ink flow path illustrated in FIG. 14.

While the third exemplary embodiment of the printing apparatus according to the invention will be described below with reference to these drawings, a difference from the above-described exemplary embodiment will be mainly described and description of the same matters will be omitted.

This exemplary embodiment is substantially the same as the first exemplary embodiment, except that a deaerating unit is provided.

A printing apparatus 1B further includes a deaerating unit 30*a* and a deaerating unit 30*b* provided in the first branch flow path 163 and the second branch flow path 164, respectively, and configured to deaerate the first branch flow path 163 and the second branch flow path 164.

The deaerating unit 30*a* is provided in the first branch flow path 163 downstream of the filter 168. The deaerating unit 30*b* is provided in the second branch flow path 164 downstream of the filter 169. The deaerating units 30*a*, 30*b* have the same arrangement, so that the deaerating unit 30*a* will be representatively described below.

The deaerating unit 30*a* is provided so as to protrude from the first branch flow path 163 and includes an air bubble storage 301 configured to store air bubbles 101 in the ink 100 and a gas permeation film 302 provided in the air bubble storage 301.

The gas permeation film 302 is formed of a film material that permeates the air bubbles 101 but not the ink 100. The air bubble storage 301 is partitioned by the gas permeation film 302 into a portion in which the ink 100 passes and a portion in which the air bubbles 101 exist.

The air bubble storage 301 is coupled with a pump 303, and by suction, the air bubbles 101 in the ink 100 move to the air bubble storage 301 through the gas permeation film 302.

According to the printing apparatus 1B, for example, as illustrated in FIG. 13, when the filter 168 is replaced with a new filter containing air and the ink 100 is replenished to the first branch flow path 163, it can be ensured that the air trapped in the new filter 168 is removed.

Although the illustrated exemplary embodiments of the printing apparatus and the printing method according to the invention have been described above, the invention is not limited by these exemplary embodiments, and each of the units configuring the printing apparatus can be changed to a unit having any configuration capable of exhibiting the same function. In addition, any structure may be added.

Moreover, the printing apparatus according to an aspect of the invention may be a combination of any two or more arrangements (features) among the exemplary embodiments.

Although each of the exemplary embodiments has the arrangement that switches between two flow paths, the invention is not limited to this, and may have an arrangement in which three or more flow paths are provided and switched.

Additionally, in the exemplary embodiments, although the case in which the first flow path and the second flow path are removable was described, the invention is not limited by this, and the first flow path and the second flow path may not be removable.

Further, in the exemplary embodiments, although the case in which the replacement operation of the first filter or the second filter is performed by an operator was described, the invention is not limited to this, for example, the printing apparatus may include a replacement mechanism of a filter, and the replacement operation may be automatically performed by the replacement mechanism.

REFERENCE SIGNS LIST

1 . . . Printing apparatus, 1A . . . Printing apparatus, 1B . . . Printing apparatus, 2 . . . Drying unit, 3 . . . Feeding device, 4 . . . Winding device, 5 . . . Supporting device, 10 . . . Machine base, 11 . . . Storage unit, 12 . . . Transport unit, 13 . . . Printing unit, 14 . . . Lifting mechanism, 15 . . . Control unit, 16 . . . Ink flow path, 17 . . . Pressure detector, 18 . . . Pressure detector, 19 . . . Electromagnetic valve, 20*a* . . . Replenishing flow path, 20*b* . . . Replenishing flow path, 20*c* . . . Waste liquid flow path, 20*d* . . . Waste liquid flow path, 21 . . . Chamber, 22 . . . Coil, 30*a* . . . Deaerating unit, 30*b* . . . Deaerating unit, 31 . . . Feeding roller, 32 . . . Tensioner, 41 . . . Winding roller, 42 . . . Tensioner, 43 . . . Tensioner, 44 . . . Tensioner, 51 . . . Main driving roller, 52 . . . Driven roller, 53 . . . Endless belt, 54 . . . Tensioner, 55 . . . Tensioner, 100 . . . Ink, 101 . . . Air bubble, 131 . . . Nozzle, 132 . . . Carriage unit, 151 . . . CPU, 152 . . . Memory unit, 161 . . . Upstream flow path, 162 . . . Downstream flow path, 163 . . . First branch flow path, 164 . . . Second branch flow path, 165 . . . Sub-storage unit, 166 . . . Valve, 167 . . . Valve, 168 . . . Filter, 168*a* . . . Filter, 169 . . . Filter, 200 . . . Movable unit, 300 . . . Notifying unit, 301 . . . Air bubble storage, 302 . . . Gas permeation film, 303 . . . Pump, A . . . Arrow, B . . . Arrow, C . . . Arrow, D . . . Arrow, P0 . . . Threshold value, P1 . . . Pressure, P2 . . . Pressure, ΔP . . . Pressure difference, S101 . . . Step, S102 . . . Step, S103 . . . Step, S104 . . . Step, S105 . . . Step, S106 . . . Step, W . . . Work

The invention claimed is:

1. A printing apparatus comprising:

a storage unit configured to store ink;

a discharge unit to which the ink is supplied from the storage unit, the discharge unit being configured to discharge the ink for printing; and an ink flow path configured to couple the storage unit to the discharge unit and allow the ink to flow down from the storage unit to the discharge unit, wherein the ink flow path includes a first flow path, a first filter provided in the first flow path and configured to collect a foreign material in the ink passing through the first flow path, a second flow path independent of the first flow path, and a second filter configured to collect a foreign material in the ink passing through the second flow path, wherein the printing apparatus is configured to switch the flow path of the ink between the first flow path and the second flow path based on a predetermined condition, wherein the ink flow path is a single flow path when leaving the storage unit that is branched into the first flow path and the second flow path.

2. The printing apparatus according to claim 1, wherein the first flow path and the second flow path meet downstream of a branch point of the first flow path and the second flow path to thereby form a single flow path to discharge unit.

3. The printing apparatus according claim 1, wherein the first filter is removable from the first flow path, and the second filter is removable from the second flow path.

4. The printing apparatus according to claim 1, wherein the first flow path is removable together with the first filter and the second flow path is removable together with the second filter.

5. The printing apparatus according to claim 1, wherein the ink flow path includes an upstream pressure detection unit provided upstream of the first filter and the second filter in the ink flow path, and configured to detect pressure in the ink flow path, and a downstream pressure detection unit provided downstream of the first filter and the second filter in the ink flow path, and configured to detect pressure in the ink flow path.

6. The printing apparatus according to claim 5, wherein the first flow path and the second flow path are switched from one to the other based on the pressure detected by the upstream pressure detection unit and the pressure detected by the downstream pressure detection unit.

7. The printing apparatus according to claim 1, further comprising:

a movable unit including the discharge unit, the movable unit being movable in a case that the printing is performed, wherein the first filter and the second filter move along with the movable unit.

8. The printing apparatus according to claim 7, wherein a replacement operation of the first filter or the second filter is performed while the printing is out of operation.

9. The printing apparatus according to claim 1, including a movable unit including the discharge unit, the movable unit being movable in a case of the printing, wherein the movement of the first filter and the second filter are regulated regardless of whether or not the movable unit is moving.

10. The printing apparatus according to claim 9, wherein a replacement operation of the first filter or the second filter is performed while the printing is in operation or out of operation.

11. The printing apparatus according to claim 1, further comprising:

a waste liquid flow path coupled with each of the first flow path and the second flow path, the waste liquid flow path being configured to discharge the ink in the first flow path and the second flow path.

12. The printing apparatus according to claim 1, further comprising:

a deaerating unit provided in each of the first flow path and the second flow path, the deaerating unit being configured to deaerate the first flow path and the second flow path.

13. A method of printing by using a printing apparatus including a storage unit configured to store ink, a discharge unit to which the ink is supplied from the storage unit, the discharge unit being configured to discharge the ink for printing, and an ink flow path configured to couple the storage unit to the discharge unit and allow the ink to flow down from the storage unit to the discharge unit, wherein the ink flow path includes a first flow path, a first filter provided in the first flow path and configured to collect a foreign material in the ink passing through the first flow path, a second flow path independent of the first flow path, and a second filter configured to collect a foreign material in the ink passing through the second flow path, wherein the ink flow path is a single flow path when leaving the storage unit that is branched into the first flow path and the second flow path, the method comprising:

performing the printing; and switching the flow path between the first flow path and the second flow path during the printing based on a predetermined condition.

* * * * *